US005221372A

United States Patent [19]

Olson

[11] Patent Number: 5,221,372

[45] Date of Patent: Jun. 22, 1993

[54] FRACTURE-TOUGH, HIGH HARDNESS STAINLESS STEEL AND METHOD OF MAKING SAME

[75] Inventor: Gregory B. Olson, Riverwoods, Ill.

[73] Assignee: Northwestern University, Evanston, Ill.

[21] Appl. No.: 835,616

[22] Filed: Feb. 13, 1992

[51] Int. Cl.[5] ..... C22C 38/52; C21D 8/00; C21D 1/06

[52] U.S. Cl. ..... 148/326; 148/328; 148/318; 148/578

[58] Field of Search ..... 420/38; 148/326, 327, 148/328, 318, 578

[56] References Cited

U.S. PATENT DOCUMENTS 3,891,477 6/1975 Lance et al. ..... 148/619

FOREIGN PATENT DOCUMENTS 535791 1/1957 Canada ..... 420/38

56-105459 8/1981 Japan ..... 420/38

1070103 5/1967 United Kingdom ..... 420/38

*Primary Examiner*—Deborah Yee

*Attorney, Agent, or Firm*—Tilton, Fallon, Lungmus & Chestnut

[57] ABSTRACT

A cryogenically-formed and tempered stainless steel is provided having improved fracture toughness and corrosion resistance at a given hardness level, such as, for example, of at least about Rc 60 for bearing applications. The steel consists essentially of, in weight %, about 21 to about 24% Co, about 11 to about 13% Cr, about 7 to about 9% Ni, about 0.1 to about 0.5% Mo, about 0.2 to about 0.3% V, about 0.28 to about 0.32% C, and the balance iron. The steel includes a cryogenically-formed martensitic microstructure tempered to include about 5 to about 10 volume % post-deformation retained austenite dispersed therein and $M_2C$-type carbides, where M is Cr, Mo, V, and/or Fe, dispersed in the microstructure.

30 Claims, 5 Drawing Sheets

FRACTURE-TOUGH, HIGH HARDNESS STAINLESS STEEL AND METHOD OF MAKING SAME

CONTRACTUAL ORIGIN OF THE INVENTION

This invention was made with Government support under Grant No.: NAG-8-144 awarded by NASA-MSFC. The Government has certian rights in the invention.

FIELD OF THE INVENTION

The present invention relates to a martensitic stainless steel having substantially improved fracture toughness and corrosion resistance at a high hardness level and to a cryogenic forming method for making the steel.

BACKGROUND OF THE INVENTION

Stainless bearing steels having high hardness levels (e.g., Rc 57–62) required for wear and fatigue resistance unfortunately suffer from limited fracture toughness. This is of particular concern in bearing applications requiring support of tensile stresses in the bearing as, for example, in the bearing races of the high speed fuel and oxidizer turbopumps of the main engine of the space shuttle. In these turbopumps, Type 440C stainless steel ball bearings/bearing races (hardness Rc 59) are used to support shafts rotating at 29,000 rpm at a temperature below minus 300° F.

In addition to high loads and low temperatures, the turbopump bearings are also subjected to hostile lubrication conditions aggravate by the corrosiveness of the liquid oxygen supplied by the turbopump to the main engine. Corrosion, in particular stress corrosion cracking, of the bearings is thus an additional concern.

The Type 440C stainless steel bearings of the high speed fuel and oxidizer pumps were designed for a service life of 55 shuttle flights before replacement. The combination of low stress corrosion resistance and low fracture toughness (e.g., 22–23 KSI in.$^{\frac{1}{2}}$ at room temperature) of the Type 440C bearing material make bearing race cracking a serious concern. As a result, the bearings are now inspected and tested thoroughly after each shuttle flight and are replaced, if necessary. This inspection and premature replacement of the bearings has become a significant source of delay and expense between shuttle flights.

There is a need for a stainless steel having improved fracture toughness and corrosion resistance at a given high hardness level (e.g., at least Rc 59) needed for service as a bearing material in the aforementioned shuttle high speed fuel and oxidizer turbopumps as well as in other service applications where load, temperature and/or corrosion conditions require a combination of high hardness (e.g., at least Rc 57) for wear and fatigue resistance, fracture toughness, and corrosion resistance.

SUMMARY OF THE INVENTION

The present invention contemplates a cryogenically-formed and tempered martensitic stainless steel to satisfy this need. In particular, the stainless steel of the invention exhibits, at a given high hardness level, substantially improved fracture toughness and corrosion resistance as compared to Type 440C stainless steel and other bearing steels.

In general, the stainless steel of the invention includes at least about 11 weight % Cr for corrosion resistance, C in an amount to achieve a selected hardness, one or more refractory metal carbide formers in amount(s) selected to form $M_2C$-type carbides, where M is the refractory metal(s), Cr and/or Fe, Co and Ni in amounts selected to provide an as-quenched austenitic microstructure cryogenically-deformable to a martensitic microstructure including a minor amount of post-deformation retained austenite dispersed therein, and the balance essentially Fe. The steel comprises a cryogenically-deformed (cryo-formed) martensitic microstructure (matrix) tempered to provide a minor, controlled amount of high stability, post-deformation retained austenite and the $M_2C$-type carbides dispersed in the matrix. Preferably, the tempered martensitic microstructure comprises a fine lath martensite including about 5 to about 10 volume % of post-deformation retained austenite and fine $M_2C$-type carbides dispersed uniformly in the matrix.

A preferred cryo-formed and tempered stainless steel of the invention exhibits a fracture toughness of at least about 40 KSI in.$^{\frac{1}{2}}$ at a hardness level of at least about Rc 59, thereby providing almost twice the fracture toughness of Type 440C stainless steel having a hardness of about Rc 59. Moreover, its corrosion resistance is generally superior to that of Type 440C.

A preferred cryogenically-formable stainless steel composition in accordance with the invention consists essentially of, in weight %, about 20 to about 30% Co, about 11 to about 13% Cr, about 5 to about 10% Ni, about 0.1 to about 0.5% Mo, about 0.2 to about 0.3% V, about 0.28 to about 0.32% C, and the balance essentially iron. A more preferred stainless steel composition consists essentially of, in weight %, about 21 to about 24% Co, about 11 to about 13% Cr, about 7 to about 9.50% Ni, about 0.1 to about 0.5% Mo, about 0.2 to about 0.3% V, about 0.28 to about 0.32% C, and the balance essentially iron. A most preferred nominal stainless steel composition consists essentially of, in weight %, about 22.5% Co, about 12% Cr, about 8.50% Ni, about 0.3% Mo, about 0.25% V, about 0.30% C, and the balance essentially iron.

The present invention also contemplates a method of making the fracture tough stainless steel of the invention by first cryogenically deforming the stainless steel in an as-quenched austenitic condition (e.g., as oil quenched from a solution temperature between 1000° and 1200° C.) to transform the microstructure to martensite that includes a minor amount of post-deformation retained austenite (e.g., less than 20 volume % in the as-deformed condition ) dispersed therein, and then tempering the cryo-formed material at a suitable elevated temperature effective to control the amount of dispersed post-deformation retained austenite at a desired level and to form a dispersion of fine $M_2C$-type carbides in the martensitic matrix to the substantial exclusion of cementite.

The amount of post-deformation retained austenite present after cryo-forming is preferably controlled by conducting a multistep (e.g., two step) cryo-forming operation wherein the as-quenched austenitic material is cryo-deformed preferably to a major extent (55% strain), subjected to an intermediate tempering treatment (e.g., 250° C. for 1 hour) to destabilize the retained austenite, and then further cryo-deformed preferably to a minor extent (5% strain). This two step cryo-forming operation provides about 15 volume % or less of the post-deformation retained austenite in the tempered martensitic matrix.

The amount of post-deformation retained austenite present after the final tempering treatment (i.e., for $M_2C$ carbide precipitation) is preferably controlled by conducting the final tempering treatment in a cyclic manner wherein the cryo-formed material is repeatedly heated to the final tempering temperature and cryogenically cooled. This preferred tempering treatment is effective to control the amount of high stability, post-deformation retained austenite in the martensitic microstructure to a preferred level of about 5 to about 10 volume % for toughness enhancement purposes.

The present invention also envisions nitriding (e.g., ion nitriding) the cryo-formed material to form a hard nitride surface case thereon. The material may be nitrided concurrently with the final tempering treatment for carbide precipitation, maintaining a high hardness core (e.g., Rc 55–60). The nitride surface case increases surface hardness of the material to about Rc 70.

Other features and advantages of the invention will become apparent from the following detailed description and drawings.

DETAILED DESCRIPTION OF THE INVENTION

Figure 1A:
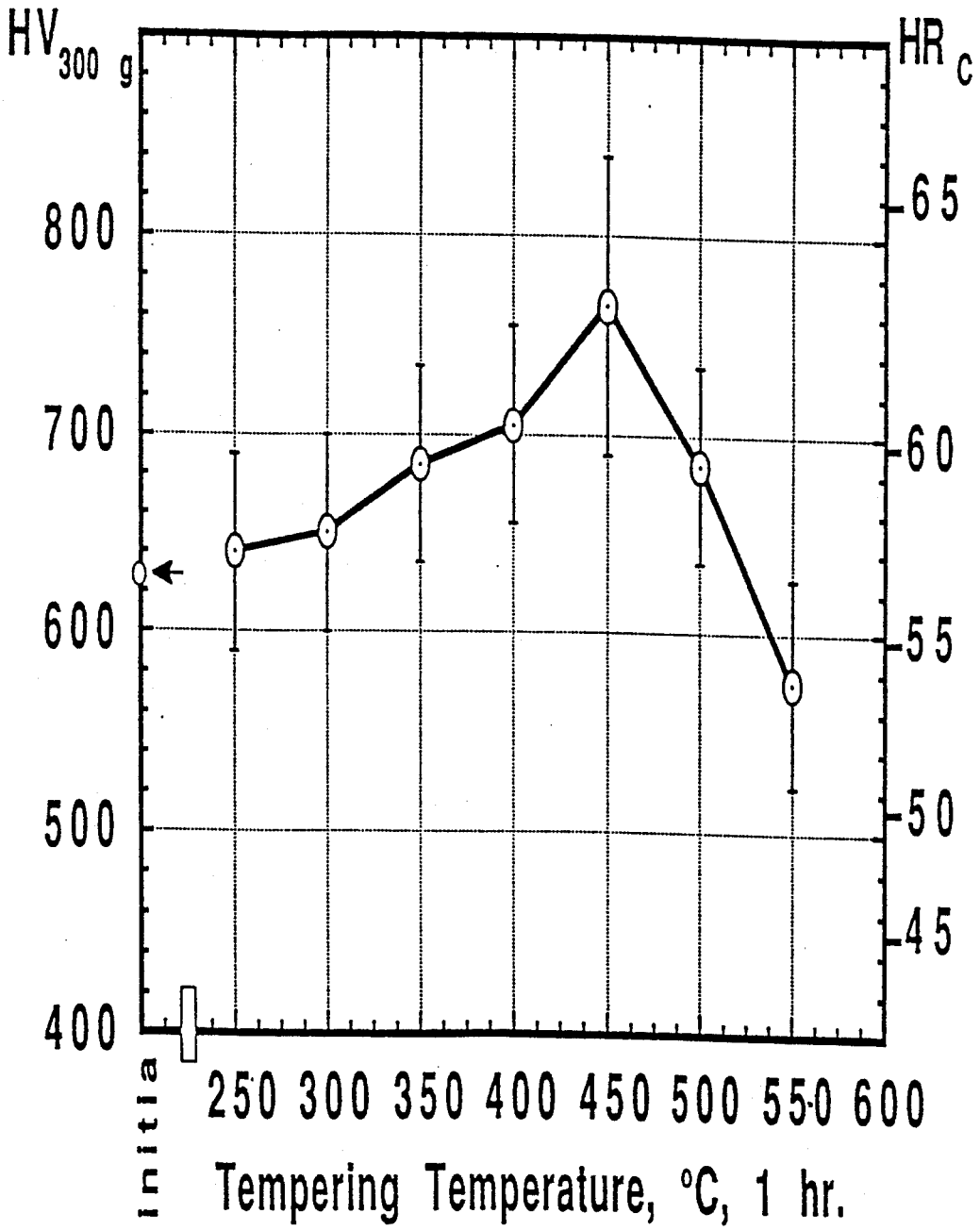
FIG. 1*a* is a graph illustrating variation of Vickers micro-hardness of the one-step cryo-formed stainless steel of the invention versus tempering temperature for a single-step tempering time of 1 hour.

The present invention provides a martensitic stainless steel that exhibits improved fracture toughness and corrosion resistance as compared to Type 440C stainless steel and other bearing steels at a given hardness level; for example, at a hardness level of about Rc 57–62 typical for a bearing steel to achieve needed wear and fatigue resistance. In general, the stainless steel of the invention exhibits a fracture toughness, as measured by ASTM test STP E399, that is twice that exhibited by Type 440C stainless steel at a hardness level of at least about Rc 60. Moreover, the stainless steel of the invention exhibits corrosion resistance superior to that of type 440C stainless steel as determined from polarization curves in aqueous 3.5% NaCl solutions (simulated sea water) and aqueous sugar solutions.

Generally, a stainless steel composition in accordance with the present invention includes at least about 11 weight % Cr, preferably at least about 12 weight % Cr, for corrosion resistance and at least about 0.28 weight % C, preferably 0.30 weight % C, to achieve a hardness of at least about Rc 57, preferably at least Rc 60 in the tempered condition. Importantly, the stainless steel composition includes Co and Ni in concentrations selected to produce an austenitic microstructure or matrix upon oil quenching from a solution temperature above about 1100° and below about 1200° C. to room temperature (72° F.). A relatively high concentration of Co, such as at least about 20 weight %, is used to this end and also for recovery resistance to promote fine scale heterogeneous precipitation of carbides during a secondary hardening treatment (tempering treatment) to be described. The Ni concentration is relatively high, such as at least 5 weight %, for fracture toughness purposes. The stainless steel composition includes a thermodynamically optimized concentration of one or more refractory metal carbide formers, such as Mo and V, to sufficiently refine strengthening carbides to provide the Rc 57 or above hardness in a high-toughness cryogenically-formed, tempered martensitic microstructure. The concentration of the carbide former is selected to allow completion of precipitation of strengthening $M_2C$-type carbides (where M is Cr, Fe, Mo, and/or V) while minimizing precipitation of undesirable $M_6C$-type carbides and promoting dissolution of cementite ($Fe_3C$), which reduces fracture toughness through microvoid nucleation. In particular, the $M_2C$ carbides are coherently precipitated to the substantial exclusion of cementite. The Mn and Si concentrations of the stainless steel of the invention are each held below about 0.01 weight % for enhanced stress corrosion resistance. The balance of the stainless steel composition of the invention is essentially iron. Th thermodynamically optimized carbide formation aspect of the stainless composition is described by the inventor in "New Steels by Design", *J. Mater. Educ.* 11, November, 1989, pp. 515–528, the teachings of which are incorporated herein by reference.

The stainless steel composition of the invention is typically vacuum induction melted and is preferably compatible with rapid solidification and La treatment, if desired, for impurity gettering to improve intergranular stress corrosion cracking resistance and stable grain refinement as described by T. J. Kinkus and G. B. Olson in "Microanalytical Evaluation of a Prototype Stainless Bearing Steel", presented at the International Field-Emission Symposium, Vienna, Austria, August, 1991, (to appear in *Surface Science*) and "Materials Design: An Undergraduate Course", *Morris E. Fine Symposium*, TMS-AIME Warrendate, Pa., October, 1990, published Feb. 17, 1991, the teachings of both of which are incorporated herein by reference. The La treatment for improving the intergranular stress corrosion cracking resistance of a Mn-Si free, high strength steel is described in the Olson et. al. U.S. Pat. No. 4,836,869. However, substantially improved fracture toughness and corrosion resistance can be achieved in practicing the invention without subjecting the stainless steel composition to the La treatment as the exemplary embodiment described herebelow will illustrate.

A preferred stainless steel composition in accordance with the invention consists essentially of, in weight %, about 20 to about 30% Co, about 11 to about 13% Cr, about 5 to about 10% Ni, about 0.1 to about 0.5% Mo, about 0.2 to about 0.3% V, about 0.28 to about 0.32% C, and the balance essentially iron. An even more preferred stainless steel composition consists essentially of, in weight %, about 21 to about 24% Co, about 11 to about 13% Cr, about 7 to about 9.50% Ni, about 0.1 to about 0.5% Mo, about 0.2 to about 0.3% V, about 0.28 to about 0.32% C, and the balance essentially iron. The preferred nominal stainless steel composition of the invention consists essentially of, in weight %, about 22.5% Co, about 12 Cr, about 8.50% Ni, about 0.3% Mo, about 0.25% V, about 0.30% C, and the balance essentially iron.

As mentioned hereabove, the stainless steel compositions of the invention will produce an austenitic microstructure when oil quenched from a solution temperature above about 1100° and below about 1200° C. to room temperature. The compositions remain austenitic upon cooling from room temperature to liquid nitrogen temperature (minus 320° F.).

The stainless steel compositions of the invention have been found to be cryogenically-formable to transform the as-quenched austenitic microstructure to a fine lath martensitic microstructure including a minor amount of post-deformation retained austenite. Transformation of the microstructure from austenitic to predominantly martensitic (i.e., including a minor amount of the retained austenite) can be effected by strain-induced tensile deformation (or hoop expansion for ring shapes) at liquid nitrogen temperature. Typically, the cryogenic deformation operation is conducted after the stainless steel material has been hot worked from bar form to plate or strip form. The hot working may comprise hot rolling, hot swaging or ring forming.

Preferably, the cryogenic deformation operation is conducted as a multistep deformation operation wherein the stainless steel material is initially deformed in tension to substantial uniform strain (e.g., 55%) at liquid nitrogen temperature, the deformed material is tempered to destabilize retained austenite by precipitation of Fe-based carbides in the martensite (e.g., a 1 hour temper at 250° C.), and the tempered material is further deformed in tension to a lesser uniform strain (e.g., 5%) at liquid nitrogen temperature. The amount of post-deformation retained austenite dispersed in the martensitic microstructure can be controlled to about 15–20 volume % using the multistep deformation operation.

For comparison purposes, a one step tensile deformation operation of the stainless steel material to a uniform strain of about 55% can be used to produce a martensitic microstructure including less than about 30 volume % of post-deformation retained austenite.

Since the volume fraction of the post-deformation retained austenite is preferably maintained in the range of about 5 to about 10 volume % in practicing the invention for improved fracture toughness purposes, the multistep deformation operation is preferred over the one step deformation operation, although the invention is not limited to a multistep deformation operation so long as only a minor amount of the retained austenite is present.

The post-deformation retained austenite present in the martensitic microstructure, especially after the multistep deformation operation, is in a relatively stable condition as compared to conventional retained austenite remaining in the microstructure after direct quenching from the solution temperature. In other words, the cryogenic deformation operation leaves a more stable retained austenite in the microstructure, especially in the event the multistep deformation operation is employed to destablize the least stable retained austenite present. In addition, the tempering operation to be described herebelow results in a more stable, post-deformation retained austenite being present in the martensitic microstructure. The post-deformation retained austenite preferably is sufficiently stable to only transform under the triaxial stresses of a mode I crack tip.

Following the cryogenic forming operation, the stainless steel material is subjected to a tempering operation (secondary hardening operation) at a suitable elevated temperature and time to further control the amount of thermally-stable, post-deformation retained austenite in the martensitic microstructure and also to achieve secondary hardening (via coherent nucleation/-precipitation of the aforementioned $M_2C$-type carbides to the substantial exclusion of cementite). Tempering may be conducted as a one step operation or, preferably, as a multistep cyclic tempering operation to develop desired mechanical properties and microstructure. Illustrative of the one step tempering operation useful in practicing the invention is to isothermally heat the cryogenically deformed stainless steel material at a suitable temperature; e.g., preferably 400°–455 C., for a suitable time to develop desired hardness and a post-deformation retained austenite volume fraction (preferably about 5 to about 10 volume %) in the martensitic microstructure.

Illustrative of a multistep cyclic tempering operation useful in practicing the invention is to heat the cryogenically deformed stainless steel material at a suitable temperature (e.g., 455° C.) for a given time (e.g., 1.5 hours) followed by cooling in air to room temperature and then to liquid nitrogen temperature and to repeat this cycle until the desired hardness and post-deformation retained austenite volume fraction are achieved.

A preferred cryogenically-formed and tempered stainless steel of the invention exhibits a hardness of at least about Rc 60 (corresponding to an UTS of at least about 350 KSI) and a fracture toughness of at least about 40 KSI in.$^{\frac{1}{2}}$ as measured by ASTM test STP E399 at room temperature. To this end, the microstructure will comprise a fine lath martensite matrix including about 5 to about 10 volume % of high stability, post-deformation reatined austenite and ultra fine (approximatley 20 nanometers) $M_2C$ carbides, both dispersed uniformly throughout the martensite matrix.

The following example is offered to further illustrate, but not limit, the invention.

EXAMPLE

A vacuum induction melted stainless steel composition comprising, in weight %, 22.5% Co, 11.8% Cr, 8.5% Ni, 0.30% Mo, 0.25% V, 0.29% C, and balance essentially Fe was supplied as a hot-forged 0.75 inch square bar by Carpenter Technology Corp. Mn and Si each were less than 0.01 weight %. The composition was not La treated in accordance with U.S. Pat. No. 4,836,869, although it is compatible with such La treatment in order to improve intergranular stress corrosion cracking resistance. The nominal composition specified was, in weight %, 22.6% Co., 12.0% Cr, 8.6% Ni, 0.30% Mo, 0.25% V, 0.30% C, and balance essentially Fe.

The 0.75 inch hot-forged bar stock was hot worked by hot prsesing to $\frac{3}{8}$ inch plate in order to provide flat tensile specimens having cryo-deformed gage sections suitable for subsequent machining into slow-bend toughness specimens.

A series of the hot worked tensile specimens was subjected to various solution treatment temperatures ranging from 1025° to 1150° C. for 1 hour to determine optimum solution conditions. Below 1100° C., a duplex grain structure was observed, associated with incomplete carbide dissolution. Electron microscopy performed on carbon extraction replicas from material solution treated at 1100°, 1125°, and 1150° C. revealed that at temperatures above 1100° C., coarse one micron scale carbides (present at 1100° C.) dissolve to leave finer 0.2 micron size carbide particles. A Cr/Mo carbide and a Cr carbide were determined to be present in the material solutioned at 1125° and 1150° C. consistent with model equilibrium predictions for (cr. 77Fe.1-3Mo.10)23C6 and (Cr.96Fe.04)7C3. A solution temperature of 1150° C. was used in conducting the remainder of the studies on the material.

Upon oil quenching to room temperature from the solution temperature, the tensile specimens were found to have an austenitic microstructure. The austenitic microstructure remained on cooling to lqiuid nitrogen temperature. A predominantly martensitic microstructure was imparted to the as-quenched specimens through strain-induced transformation by tensile deformation. For example, after uniform tensile deformation to a strain of 55%, saturation magnetization measurements revealed the post-deformation retained austenite volume fraction to be less than 30% in a fine lath martensitic matrix. Electron microscopy showed that the retained austenite was uniformly dispersed in the matrix.

Figure 1B:
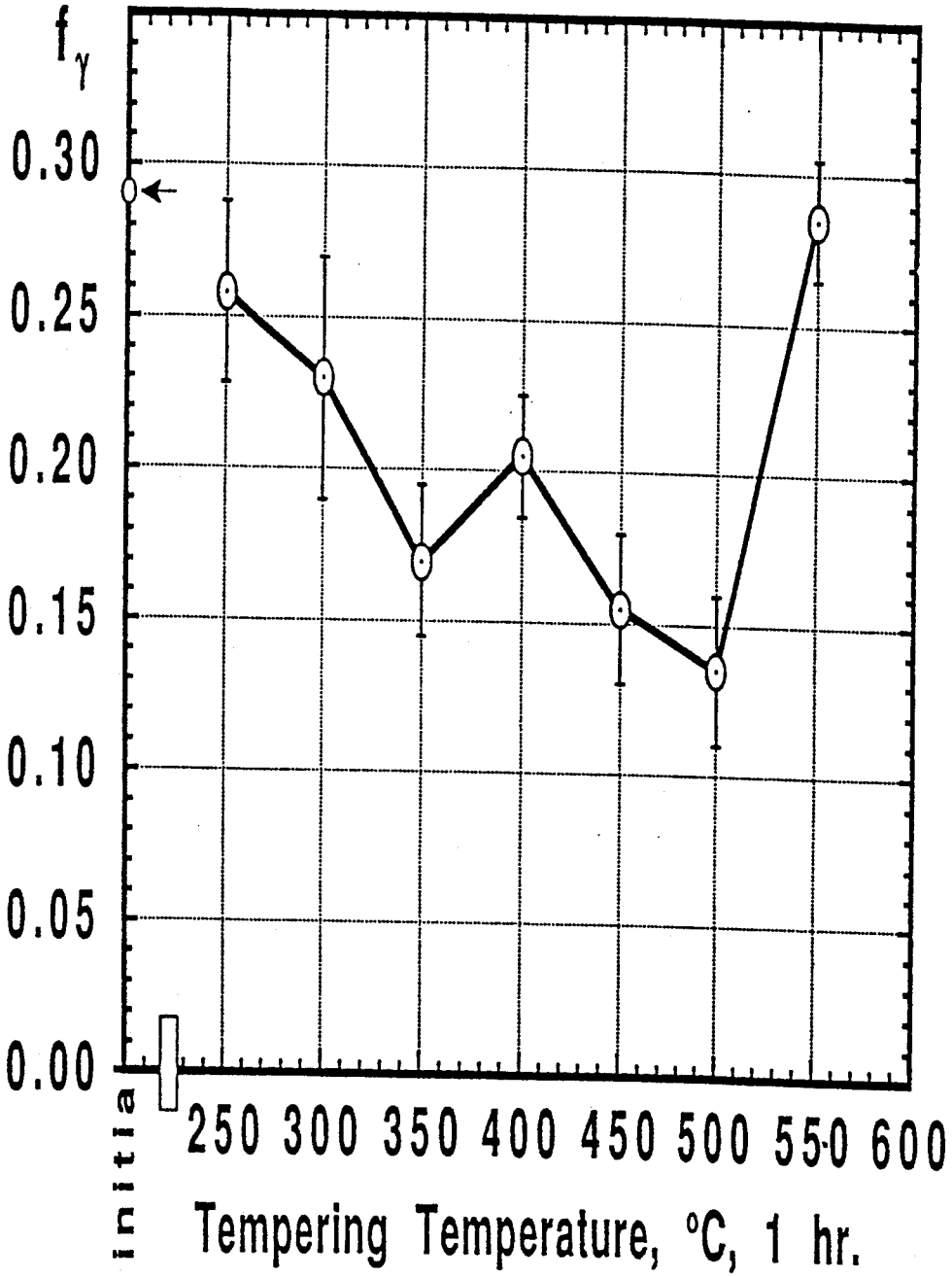
FIG. 1*b* is a graph illustrating the corresponding variation of austenite volume in the martensitic matrix fraction with tempering temperature.

In FIG. 1*a*, specimens subjected to this one step cryo-forming operation were aged or temperated for 1 hour at the various temperatures shown. The variation of hardness with tempering temperature is apparent. The maximum hardness was achieved at 450° C. for the 1 hour treatment. The corresponding volume fraction of post-deformation retained austenite in the martensitic microstructure is shown in FIG. 1*b*. The onset of austenite precipitation appears to occur above 500° C.

Some of the precipitated carbides from the 500° C./1 hour tensile specimen (corresponding to slightly overaged condition and near completion of $M_2C$ precipitation) were analyzed. Microanalysis employing VG FIM 100 atom-probe showed the carbides to have a composition of (Cr.88 Mo.03 V.03 Fe.06)2C.92 which lies between model predicted values for coherent and incoherent $M_2C$ equilibrium.

FIG. 1*b* indicates that the amount of post-deformation retained austine in the fine lath martensitic microstructure was reduced by tempering below 500° C. In order to achieve lower amounts of post-deformation retained austenite, a two step cryogenic deformation operation was employed wherein the as-quenched tensile specimens were initially cryogenically eformed in tension to a uniform strain of 50% at liquid nitrogen temperature, tempered at 250° C. for 1 hour to destablize the retained austenite by precipitation of iron carbides in the martensite, and subsequently cryogenically deformed in tension to a uniform strain of approximately 5% at liquid nitrogen temperature. Saturation magnetization measurements indicated that this multi-step cryo-forming operation reduced the post-deformation retained austenite to about 15 volume % or less of the fine lath martensitic matrix.

Figure 2A:
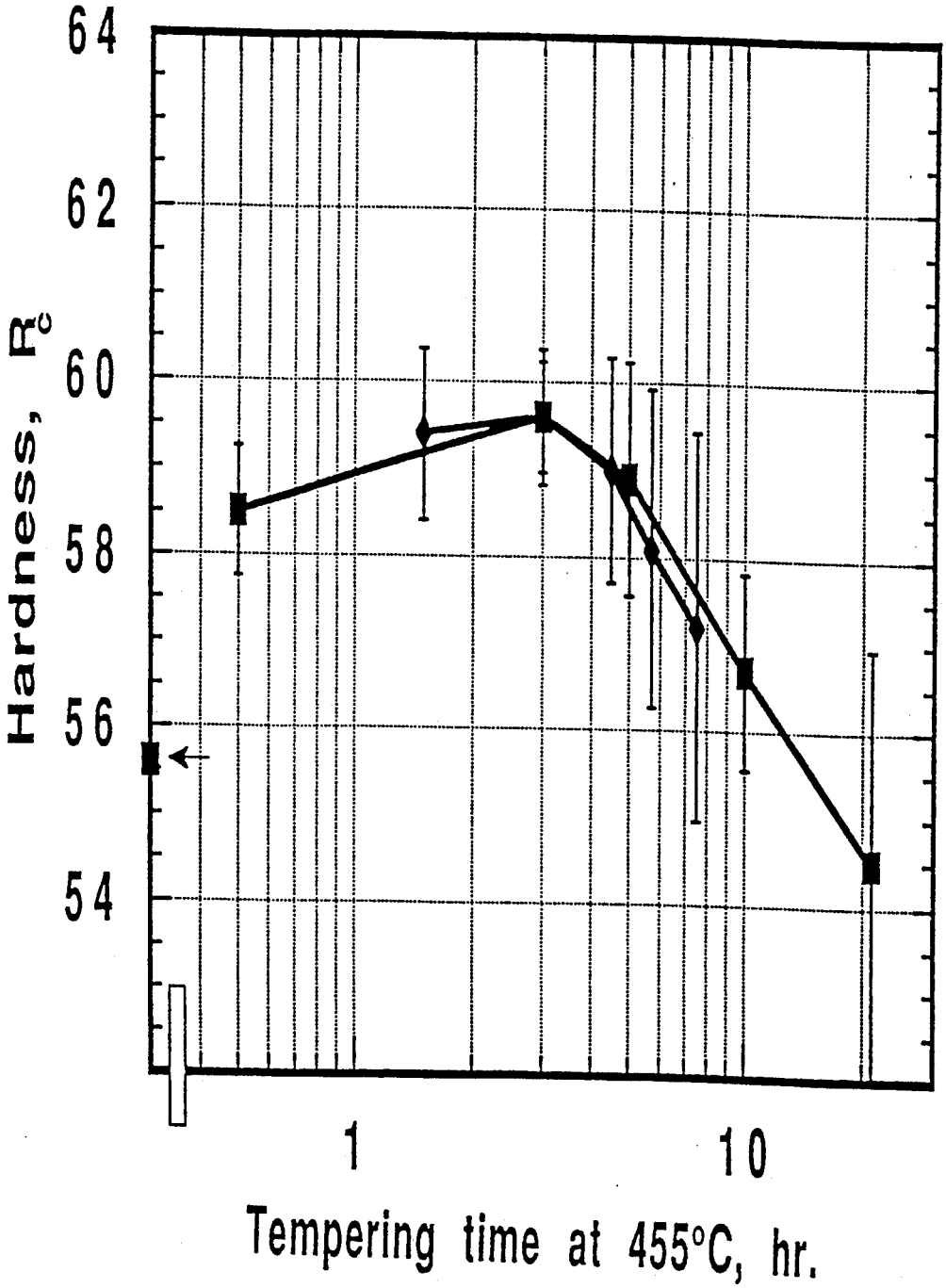
FIG. 2*a* is a graph illustrating variation of Rc hardness of the two-step (with intermediate temper) cryo-formed stainless steel of the invention versus tempering time at a temperature of 455° C. Square data points denote isothermal tempering and diamond points denote cyclic tempering with 1.5 hour cycles.
Figure 2B:
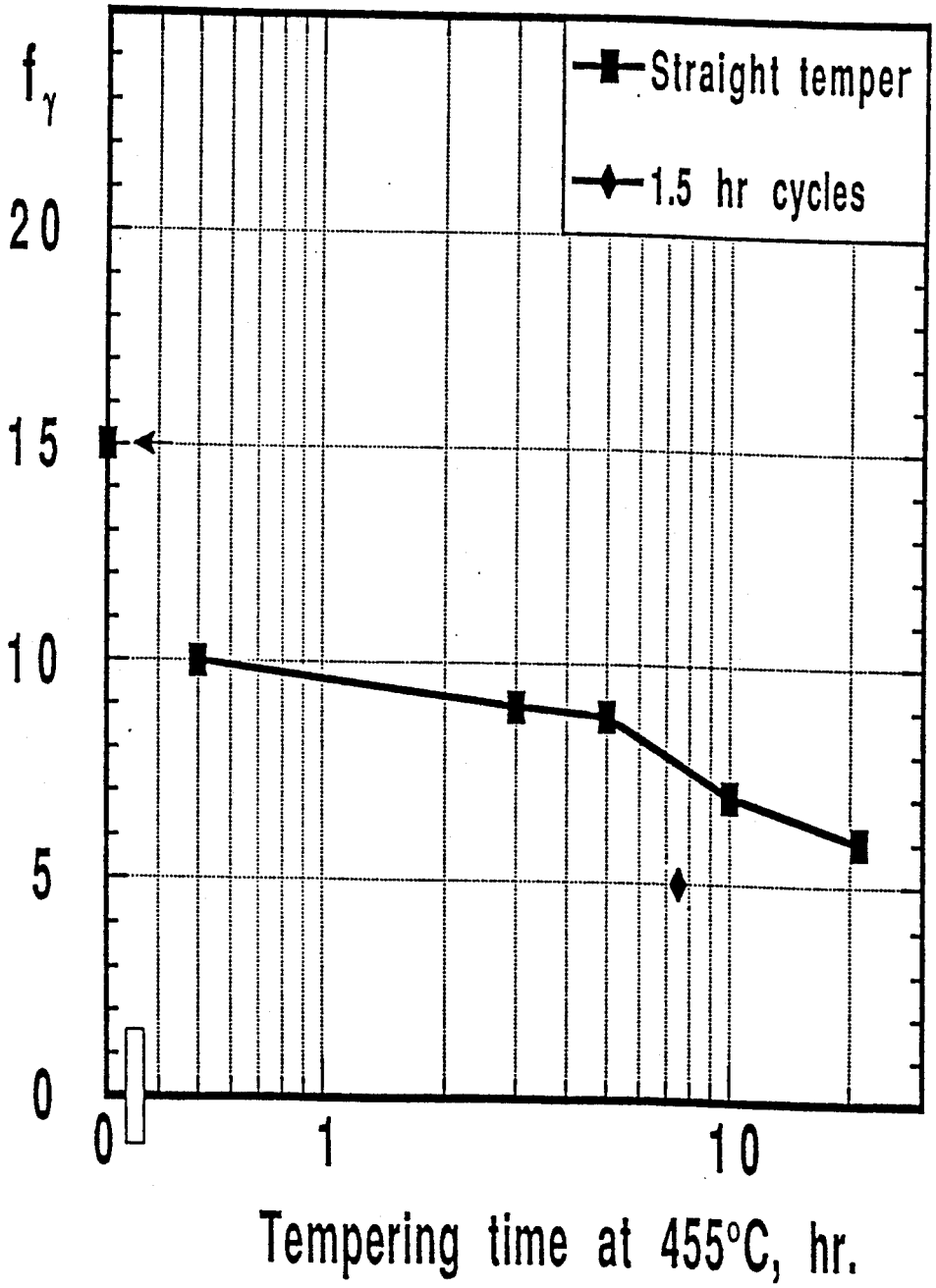
FIG. 2*b* is a graph illustrating the corresponding variation of austenite volume fraction in the martensitic matrix with the tempering time at a temperature of 455° C.

The isothermal tempering response of tensile specimens subjected to the two step cryo-forming operation (i.e., having about 15 volume % retained austenite) is summarized in FIG. 2*a*, 2*b*. The data for these isothermally treated specimens is represented by the square-shaped data points. FIG. 2*a* shows the variation of hardness with temperating time at 455° C. FIG. 2*b* shows variation of the volume fraction of post-deformation retained austenite with tempering time at 455° C.

The response of similar two step cryo-forming specimens to a cyclic temperng treatment is also shown in FIGS. 2*a*, 2*b*. The data for these cyclic tempered specimens is represented by the diamond data points. The cyclic tempering treatment comprised cycles where each cycle involved heating the speciment at the 455° tempering temperature for 1.5 hours, cooling in air to room temperature (RT) and then to liquid nitrogen temperature. The aim of the cyclic tempering treatment was to controllably reduce the amount of thermally-stable, post-deformation retained austenite to the preferred levels of about 5 to about 10 volume % of the fine lath martensitic matrix.

For both the isothermal and the cyclic tempering treatments, a peak hardness of near Rc 60 was reached at 3 hours. For the isothermal tempering treatment, the volume fraction of post-deformation retained austenite is reduced from an initial value of about 15% to a final value of about 6% after 120 hours of tempering. For the cyclic tempering treatment, the volume fraction of retained austenite is reduced from the same initial value (15%) to about 5% after 7.5 hours of tempering.

For fracture toughness measurements, specimens were machined from the gage sections of the tensile specimens. The toughness specimens were 5×11 mm cross-section, pre-cracked slow bend specimens in accordance with STP E399 ASTM test. Fracture toughness ($K_{IC}$) was determined for material that was subjected to the two step cryo-forming operation described above and then tempered under different conditions (isothermal or cyclic); namely, 1) tempered at 200° C. for 1 hour to achieve a hardness of almost Rc 57 (isothermal), 2) tempered at 455° C. for 2.0 hours, cooled to RT in air and then to liquid nitrogen temperature, tempered at 455° C. for 2.0 hours, cooled to RT in air and then to liquid nitrogen temperature and tempered at 400° C. for 4 hours to achieve a hardness of Rc 60.4 (cyclic temper) and 3) tempered at 455° C. for 3.5 hours, cooled to RT in air and then to liquid nitrogen temperature, and at 455° C. for 3.5 hours to achieve a hardness of Rc 58.9 (cyclic temper).

Figure 3:
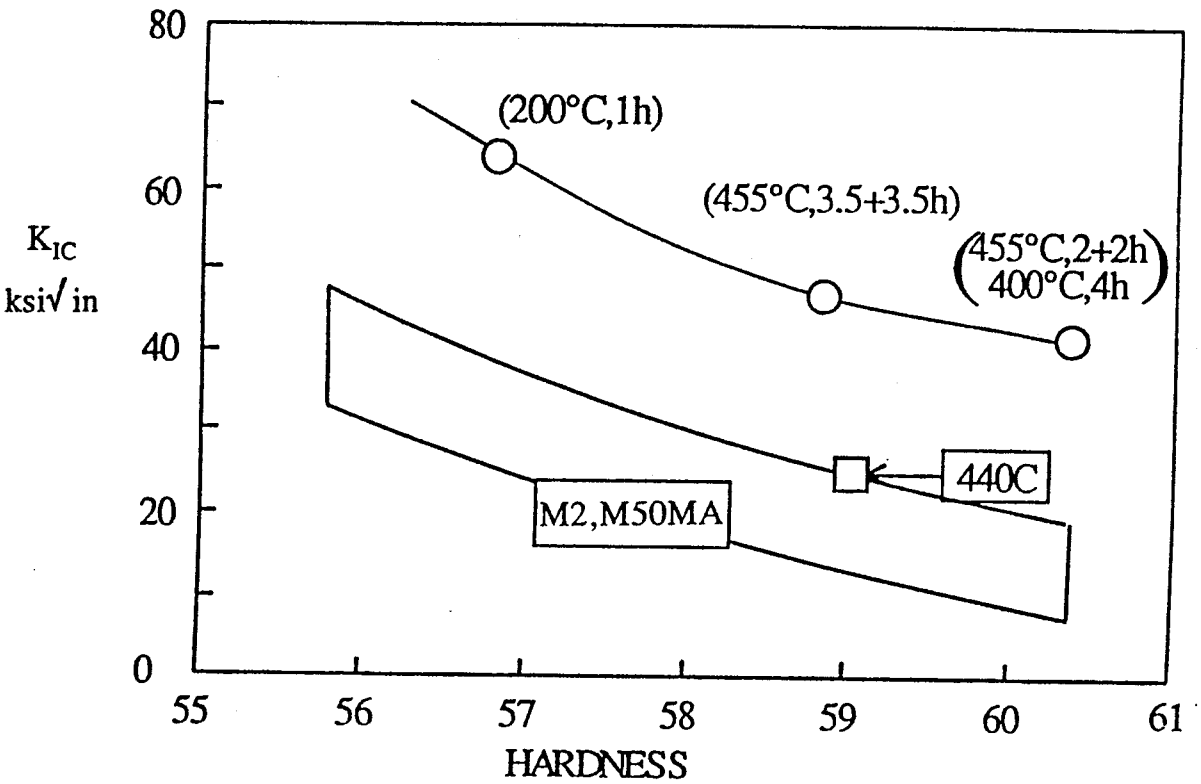
FIG. 3 is a graph illustrating the variation of fracture toughness versus hardness of the two-step cryo-formed and cyclic tempered stainless steel of the invention and conventional Type 440C, M2, and M50 matrix steels.

The measured fracture toughness is compared in FIG. 3 with that of existing bearing steels, including Type 440C currently used in the space shuttle high speed fuel and oxidizer turbopumps. The cryo-formed and tempered stainless steel in accordance with the invention demonstrates an extraordinary advance in fracture toughness at the hardness levels shown. Notably, the specimen subjected to cyclic tempering treatment #2 hereabove achieved a $K_{IC}$ of 43 KSI (47 MPa ml/2) at Rc 60.4 that is twice the fracture toughness exhibited by the Type 440C bearing stainless steel at a hardness of Rc 59.

The corrosion resistance of the specimen subjected to cyclic tempering #2 was evaluated vis-a-vis Type 440C using potentiometer polarization curves generated in an aqueous 3.5% NaCl solution (simulated sea water) and in an aqueous sugar solution (1% sucrose water), both at neutral pH. The polarization curves indicated that the corrosion resistance of the stainless steel of the invention wa superior to that of Type 440C in terms of equilibrium corrosion potentials and corrosion rates.

The invention envisions further increasing the hardness of the aforementioned cryo-formed and tempered stainless steels of the invention by subjecting them to a nitriding treatment to form a nitride surface case thereon. For example, the stainless steels of the invention can be ion nitrided in accordance with conventional ion nitriding practice to form a thin surface case thereon that raises surface hardness to about Rc 70. For purposes of illustration, a specimen having the composition set forth above in the Example was cryo-formed using the two step cryo-forming operation and tempered/ion nitrided concurrently in a conventional nitriding device. The conditions of ion nitriding were as follows:

substrate temperature: 455° C.
substrate biasing: 700–950 volts DC
nitriding atmosphere: 3:1 $H_2/N_2$ by volume
nitrogen partial pressure: $1\times10^{-4}$ atmosphere
time: 4 hours A nitrided surface case 0.1 millimeter-inoh in thickness was formed on the substrate, providing a measured surface hardness of Rc 70. The invention envisions forming deeper nitride cases by using lower tempering-/nitriding temperatures for longer times.

The cryo-formed and tempered stainless steels of the invention with and without nitriding show great promise for a new class of high performance steels for service in bearing applications (e.g., the shuttle turbopump bearings, gas turbine engine bearings) and stainless steel cutting tool applications (surgical instruments, cutlery) where a high hardness in combination with improved fracture toughness and corrosion resistance is desired.

Although the present invention has been described in connection with certain preferred embodiments, those skilled in the art will appreciate that the invention is not limited to these embodiments but rather only as defined in the appended claims.

I claim:

1. A cyrogenically-formed and tempered stainless steel having improved fracture toughness and croosion resistance at a given hardness level, said steel includign at least about 11 weight % Cr for corrosion resistance, at least about 0.28 weight % C for hardness, one or more refractory metal carbide formers in an amount selected to form $M_2C$-type carbides, where M is the refractory metal(s), Cr and/or Fe, Co and Ni in amounts selected to provide an as-quenched austenitic microstructure cryogenically-deformable to a martensitic microstructure including a minor amount of post deformation retained austenite, and the balance essentially Fe, said steel having a cyrogenically-formed martensitic microstructure tempered to include a minor, controlled amount of post-deformation retained austenite and dispersed $M_2C$-type carbides.

2. The stainless steel of claim 1 consisting essentially of at least about 0.28 weight % C, at least about 20 weight % Co, at least about 5 weight % Ni, and at least about 0.1 weight % Mo and 0.2 weight % V as the carbide formers.

3. The stainless steel of claim 2 wherein the tempered martensitic microstructure includes about 5 to about 10 volume % of post-deformation retained austenite dispersed therein.

4. A stainless steel having improved fracture toughness and corrosion resistance at a given hardness level, consisting essentially of, in weight %, about 20 to about 30% Co, about 11 to about 13% Cr, about 5 to about 10% Ni, about 0.1 to about 0.5% Mo, about 0.2 to about 0.3% V, about 0.28 to about 0.32% C, and the balance iron, said steel having a cryogenically-formed martensitic microstructure tempered to include about 5 to about 10 volume % of post-deformation retained austenite dispersed therein and including $M_2C$-type carbides, where M is Cr, Mo, V, and/or Fe, dispersed therein.

5. A stainless steel having improved fracture toughness and corrosion resistance at a hardness level of at least about Rc 57, consisting essentially of, in weight %, about 21 to about 24% Co, about 11 to about 13% Cr, about 7 to about 9.50% Ni, about 0.1 to about 0.5% Mo, about 0.2 to about 0.3% V, about 0.28 to about 0.32% C, and the balance iron, said steel having a cryogenically-formed martensitic microstructure tempered to include about 5 to about 10 volume % of post-deformation retained austenite dispersed therein and including $M_2C$-type carbides, where M is Cr, Mo, V and/or Fe, dispersed therein.

6. A stainless steel having improved fracture toughness and corrosion resistance at a hardness level of at least Rc 60, consisting essentially of, in weight %, about 22.5% Co, about 12% Cr, about 8.50% Ni, about 0.3% Mo, about 0.25% V, about 0.30% C, and the balance iron, said steel having a cryogenically-formed martensitic microstructure tempered to include about 5 to about 10 volume % of post-deformation retained austenite dispersed therein and including $M_2C$-type oarbides, where M is Cr, Mo, V, and/or Fe, dispersed therein.

7. The stainless steel of claim 5 having a fracture toughness of at least about 40 KSI in.$^{\frac{1}{2}}$ at room temperature as measured by ASTM STP E399 test.

8. The stainless steel of claim 4 having a nitride surface case thereon.

9. The stainless steel of claim 5 having a nitride surface case thereon.

10. A bearing comprising the stainless steel of claim 5.

11. A stainless steel composition that is cryogenically-formable to produce a predominantly martensitic microstructure, consisting essentially of, in weight %, about 20 to about 30% Co, about 11 to about 13% Cr, about 5 to about 10% Ni, about 0.1 to about 0.5% Mo, about 0.2 to about 0.3% V, about 0.28 to about 0.32% C, and the balance iron.

12. A stainless steel composition that is cryogenically-formable to produce a predominantly martensitic microstructure consisting essentially of, in weight %, about 21 to about 24% Co, about 11 to about 13% Cr, about 7 to about 9.50% Ni, about 0.1 to about 0.5% Mo, about 0.2 to about 0.3% V, about 0.28 to about 0.32% C, and the balance iron.

13. A stainless steel composition that is cryogenically-formable to produce a predominantly martensitic microstructure consisting essentially of, in weight %, about 22.5% Co, about 12% Cr, about 8.50% Ni, about 0.3% Mo, about 0.25% V, about 0.30% C, and the balance iron.

14. A method of making a stainless steel having improved fracture toughness and corrosion resistance at a given hardness level, comprising the steps of:

a) providing a stainless steel including at least about 11 weight % Cr for corrosion resistance, at least about 0.28 weight % C for temper hardness, a refractory metal carbide former in an amount selected to form $M_2C$-type carbides, where M is the refractory metal, Cr and/or Fe, Co and Ni in amounts selected to provide an as-quenched austenitic microstructure that is cryogenically-deformable to a martensitic microstructure including a minor amount of post deformation retained austenite dispersed therein, and the balance essentially Fe, b) cryogenically-deforming the steel in the as-quenched condition to transform the austenitic microstructure to a martensitic microstructure including a minor amount of post-deformation retained austenite dispersed therein, and c) tempering the cryogenically-deformed steel at an elevated temperature to control the amount of post-deformation retained austenite dispersed in the microstructure and to form the $M_2C$-type carbides dispersed in the microstructure.

15. A method of making a stainless steel having improved fracture toughness and corrosion resistance at a given hardness level, comprising the steps of:

a) cryogenically deforming an as-quenched austenitic stainless steel consisting essentially of, in weight %, about 20 to about 30% Co, about 11 to about 13% Cr, about 5 to about 10% Ni, about 0.1 to about 0.5% Mo, about 0.2 to about 0.3% V, about 0.28 to about 0.32% C, and the balance iron, to form a martensitic microstructure including a minor amount of post-deformation retained austenite dispersed in the microstructure, and b) tempering the deformed stainless steel at an elevated temperature to provide about 5 to about 10 volume % of post-deformation retained austenite dispersed in the microstructure and to form $M_2C$-type carbides, where M is Cr, Fe, Mo and/or V, dispersed in the microstructure.

16. A method of making a stainless steel having improved fracture toughness and corrosion resistance at a hardness level of at least about Rc 57, comprising the steps of:

a) cryogenically deforming an as-quenched austenitic stainless steel consisting essentially of, in weight %, about 21 to about 24% Co, about 11 to about 13% Cr, about 7 to about 9.50% Ni, about 0.1 to about 0.5% Mo, about 0.2 to about 0.3% V, about 0.28 to about 0.32% C, and the balance iron, to form a martensitic microstructure including less than about 15 volume % of post-deformation retained austenite dispersed in the microstructure, and b) tempering the deformed stainless steel at an elevated temperature to provide about 5 to about 10 volume % of post-deformation retained austenite dispersed in the microstructure and to form $M_2C$-type carbides, where M is Cr, Fe, Mo and/or V, dispersed in the microstructure.

17. A method of making a stainless steel having improved fracture toughness and corrosion resistance at a hardness level of at least about Rc 60, comprising the steps of:

a) cryogenically deforming an as-quenched austenitic stainless steel consisting essentially of, in weight %, about 22.5% Co, about 12% Cr, about 8.50% Ni, about 0.3% Mo, about 0.25% V, about 0.30% C, and the balance iron, to form a martensitic microstructure including less than about 15 volume % of post-deformation retained austenite dispersed in the microstructure, and b) tempering the deformed stainless steel at an elevated temperature to provide about 5 to about 10 volume % of post-deformation retained austenite dispersed in the microstructure and to form $M_2C$. type carbides, where M is Cr, Fe, Mo and/or V, dispersed in the microstructure.

18. The method of claim 14 including the further step of nitriding the cryogenically deformed stainless steel to form a nitrided surface case thereon.

19. The method of claim 15 including the further step of nitriding the cryogenically deformed stainless steel to form a nitrided surface case thereon.

20. The method of claim 16 including the further step of nitriding the cryogenically deformed stainless steel to form a nitrided surface case thereon.

21. The method of claims 18, 19 or 20 wherein the stainless steel is nitrided during the tempering step.

22. The method of claim 21 wherein the stainless steel is ion nitrided.

23. The method of claim 14 wherein the cryogenically deformed stainless steel is tempered to destabilize the retained austenite and the tempered stainless steel is further cryogenically deformed.

24. The method of claim 15 wherein the cryogenically deformed stainless steel is tempered to destabilize the retained austenite and the tempered stainless steel is further cryogenically deformed.

25. The method of claim 16 wherein the cryogenically deformed stainless steel is tempered to destabilize the retained austenite and the tempered stainless steel is further cryogenically deformed.

26. The method of claim 14 wherein the cryogenically deformed steel is tempered by repeatedly heating the steel to the tempering temperature and cryogenically cooling.

27. The method of claim 15 wherein the cryogenically deformed steel is tempered by repeatedly heating the steel to the tempering temperature and cryogenically cooling.

28. The method of claim 16 wherein the cryogenically deformed steel is tempered by repeatedly heating the steel to the tempering temperature and cryogenically cooling.

29. A cryogenically-formed and tempered stainless steel having improved fracture toughness and corrosion resistance, said steel including at least about 11 weight % Cr for corrosion resistance, C in an amount to achieve a hardness of at least about Rc 57, one or more refractory metal carbide formers in an amount selected to form $M_2C$-type carbides, where M is the refractory metal (s), Cr and/or Fe, Co and Ni in amounts selected to provide an as-quenched austenitic microstructure cryogenically-deformable to a martensitic microstructure including a minor amount of post deformation retained austenite, and the balance essentially Fe, said steel having a cryogenically-formed martensitic microstructure tempered to include a minor, controlled amount of post-deformation retained austenite and dispersed $M_2C$-type carbides.

30. A method of making a stainless steel having miproved fracture toughness and corrosion resistance, comprising the steps of:

a) providing a stainless steel including at least about 11 weight % Cr for corrosion resistance, C in an amount to achieve a temper hardness of at least about Rc 57, a refractory metal carbide former in an amount selected to form $M_2C$-type carbides, where M is the refractory metal, Cr and/or Fe, Co and Ni in amounts selected to provide an as-quenched austenitic microstructure that is cryogenically-deformable to a martensitic microstructure including a minor amount of post deformation retained austenite dispersed therein, and the balance essentially Fe, b) cryogenically-deforming the steel in the as-quenched condition to transform the austenitic microstructure to a martensitic microstructure including a minor amount of post-deformation retained austenite dispersed therein, and c) tempering the cryogenically-deformed steel at an elevated temperature to control the amount of post-deformation retained austenite dispersed in the microstructure and to form the $M_2C$-type carbides dispersed in the microstructure, said tempered microstructure having a hardness of at least about Rc 57.

* * * * *

UNITED STATES PATENT AND TRADEMARK OFFICE

CERTIFICATE OF CORRECTION

PATENT NO. : 5 221 372

DATED : June 22, 1993

INVENTOR(S) : Gregory B. OLSON

It is certified that error appears in the above-identified patent and that said Letters Patent is hereby corrected as shown below:

Column 9, line 36; replace "croosion" with ---corrosion---.

line 37; replace "includign" with ---including---.

Signed and Sealed this

Thirty-first Day of May, 1994

Bruce Lehman

*Attest:*

BRUCE LEHMAN

*Attesting Officer*

*Commissioner of Patents and Trademarks*